US006471527B2

(12) United States Patent
Fukamachi et al.

(10) Patent No.: US 6,471,527 B2
(45) Date of Patent: Oct. 29, 2002

(54) LEVER-TYPE CONNECTOR WITH ENGAGEMENT MARKERS

(75) Inventors: Makoto Fukamachi; Kazunori Yamashita, both of Yokkaichi (JP)

(73) Assignee: Sumitomo Wirging Systems, Ltd., Mie (JP)

( * ) Notice: Subject to any disclaimer, the term of this patent is extended or adjusted under 35 U.S.C. 154(b) by 0 days.

(21) Appl. No.: 09/902,171

(22) Filed: Jul. 11, 2001

(65) Prior Publication Data

US 2002/0019156 A1 Feb. 14, 2002

(30) Foreign Application Priority Data

Aug. 11, 2000 (JP) ..... 2000-244065

(51) Int. Cl.[7] ..... H01R 13/62
(52) U.S. Cl. ..... 439/157; 439/489
(58) Field of Search ..... 439/157, 155, 439/315, 488, 489

(56) References Cited

U.S. PATENT DOCUMENTS 5,476,390 A 12/1995 Taguchi et al. ..... 439/157
5,810,612 A * 9/1998 Flask et al. ..... 439/157
6,203,340 B1 * 3/2001 Yamashita et al. ..... 439/157
6,213,795 B1 * 4/2001 Drescher et al. ..... 439/157

* cited by examiner

*Primary Examiner*—Tho D. Ta
(74) *Attorney, Agent, or Firm*—Banner & Witcoff, Ltd.

(57) ABSTRACT

A lever-type connector simply and reliably shows whether male and female connector housings have been correctly fitted together. A posterior face of the female housing 16 has a cover 17. A lever 20 is provided with cam grooves 30 into which fit follower pins 32 of a male connector M and which is supported pivotably by axles 25 formed in the cover 17. The female housing 16 is correctly fitted within a hood 12 of a male housing 11 by pivoting the lever 20 from a start position to and end position. First ribs 40 are formed on the outer circumference of base ends 22 of arms 21 of the lever 20. Second ribs 45 are formed on left and right edges of a ceiling face 17A of the cover 17. When the lever 20 has been pivoted to the end position, these ribs 40 and 45 are aligned. Observing this alignment allows one to ascertain that the lever 20 is in the correct position.

17 Claims, 5 Drawing Sheets

LEVER-TYPE CONNECTOR WITH ENGAGEMENT MARKERS

TECHNICAL FIELD

The present invention relates to a lever-type electrical connector.

BACKGROUND TO THE INVENTION

Conventionally, when a connector such as a multi-polar connector has a high fitting force, this fitting force is provided by means of a lever.

This lever-type connector has, for example, a configuration whereby a male housing is provided with cam grooves on a lever pivoted on the male housing, and a corresponding female housing is provided with follower pins which can be inserted into the cam grooves. The two housings can be fitted together when the lever is in a starting position, and the follower pins are fitted into openings of the cam grooves. When the lever is pivoted, the follower pins move within these cam grooves, this drawing the two housings together and causing them to be fully fitted. That is, this lever is operated so as to fit the two housings together using a low application force.

An example of this type of lever-type connector is described in JP 6-275337.

In this type of lever-type connector, in which the two connector housings are fitted together by pivoting the lever to an end position, the fitting causes mutually facing male and female terminal fittings to be joined correctly together. However, it is difficult to judge merely by observation whether the lever has been moved correctly to the end position, and this judgement may be unreliable. In order to deal with this problem, fitting detection using electrical means has been employed. However, this method increases costs.

The present invention has taken the above problem into consideration, and aims to present a lever-type connector wherein one can simply and reliably determine whether two connectors have been correctly fitted together.

SUMMARY OF THE INVENTION

According to the invention there is provided a lever-type connector assembly comprising a pair of mutually engageable connectors, a lever pivotably supported on one of the connectors and defining a cam, and the other of said connectors defining a follower engageable with said cam such that pivoting of said lever to an end position draws said connectors fully together, wherein said lever and said one of said connectors include markers, said markers being aligned in the end position of said lever. Preferably said markers are in the form of protruding ribs which are aligned lengthwise in the end position. Alignment of such ribs can be observed from three mutually different directions.

The ribs may be of equal thickness and equal height so as to be flush in the end position. Alternatively one rib may have a different height or thickness to another in order to allow both ribs of an aligned pair to be observed. In this case, the outer rib, considering the direction of viewing, should be of reduced thickness or of reduced height so as not to mask the inner rib.

BRIEF DESCRIPTION OF DRAWINGS

Other features of the invention will be apparent from the following description of several preferred embodiments shown by way of example only in the accompanying drawings in which.

A first embodiment of the present invention is described below with the aid of FIGS. 1 to 6.

Figure 1:
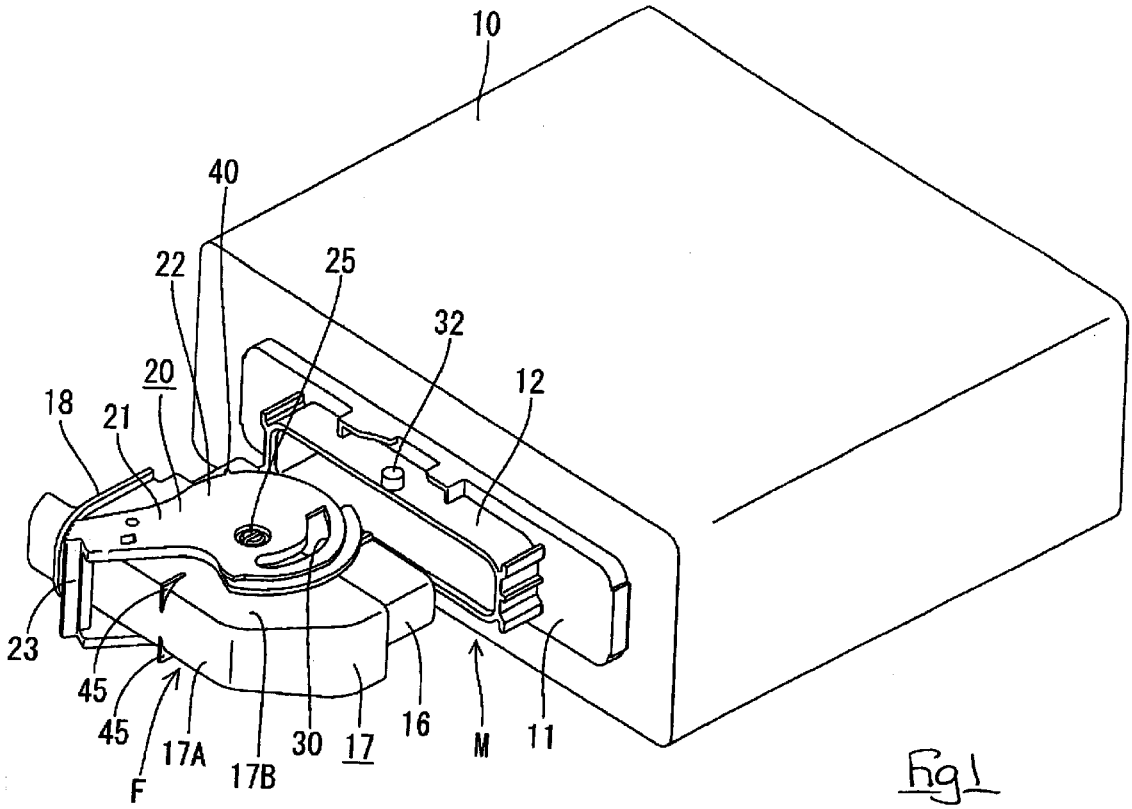
FIG. 1 is a diagonal view showing a first embodiment of the present invention prior to being fitted together.

As shown in FIG. 1, the present embodiment is provided with a male connector M and a female connector F capable of fitting mutually together, the female connector F having a lever 20 attached thereto.

The male connector M is provided with a male housing 11 provided in a unified manner on a specified side face of an apparatus 10. A hood 12, which has an oblong shape with respect to the front, is formed on the male housing 11. Male terminal fittings (not shown), which are connected to an electrical circuit within the apparatus 10, are housed within the male housing 11 in a manner whereby tips thereof protrude into the hood 12.

The female connector F is formed from a flat block-shaped female housing 16 that can be fitted into the hood 12 of the male housing 11, and a cover 17 that covers a posterior face of the female housing 16. Female terminal fittings (not shown) are housed within the female housing 16, electric wires which are attached thereto and protrude from a posterior face of the female housing 16 are passed through the cover 17 and are led, in one bundle, towards one direction from a wire exit hole 18.

Figure 2:
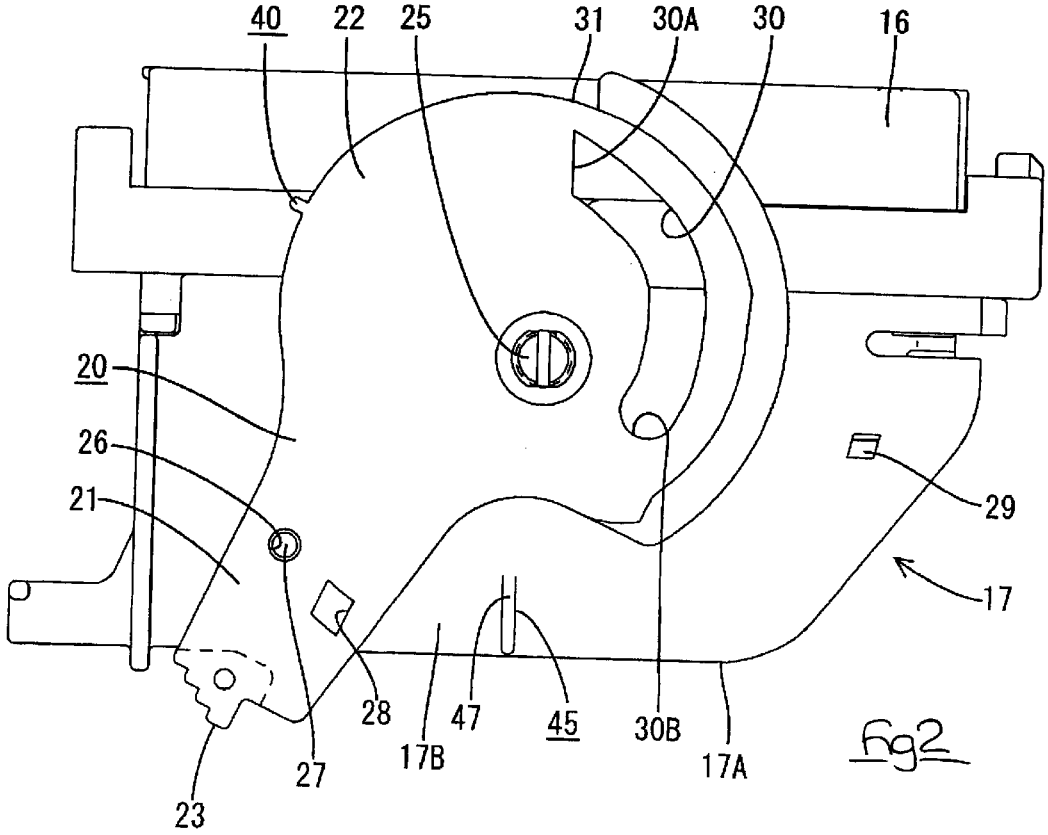
FIG. 2 is a plan view of a female connector.
Figure 3:
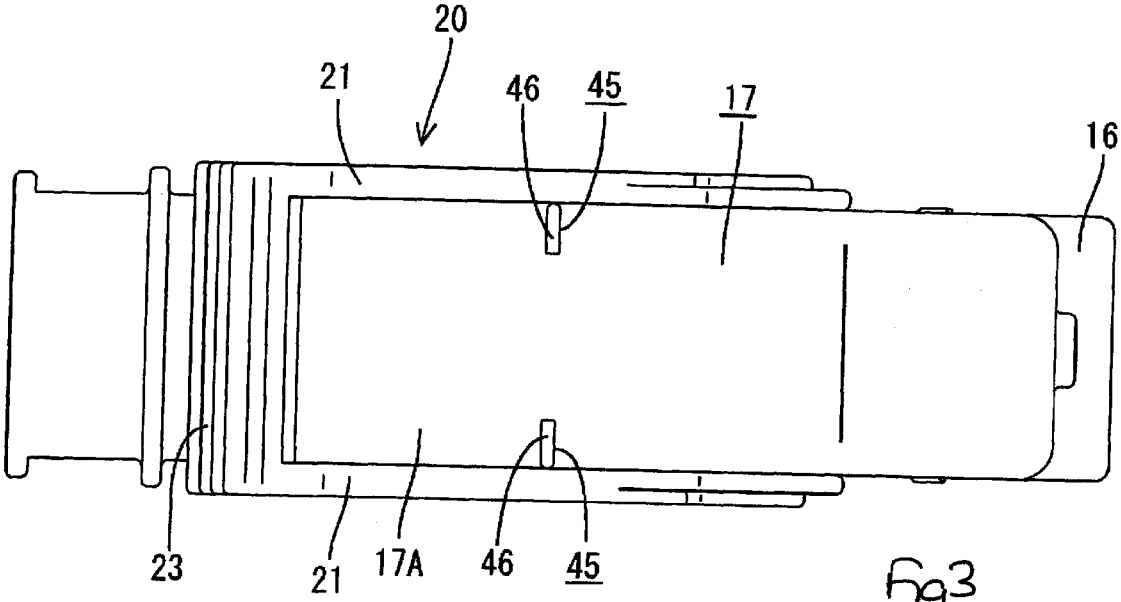
FIG. 3 is a front view of the female connector.
Figure 4:
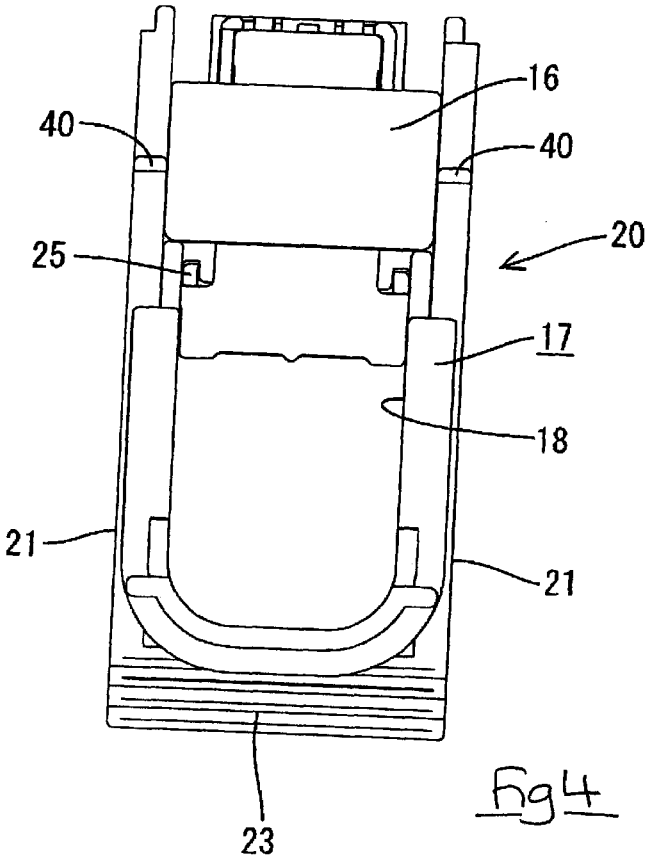
FIG. 4 is a side face view of the female connector.
Figure 5:
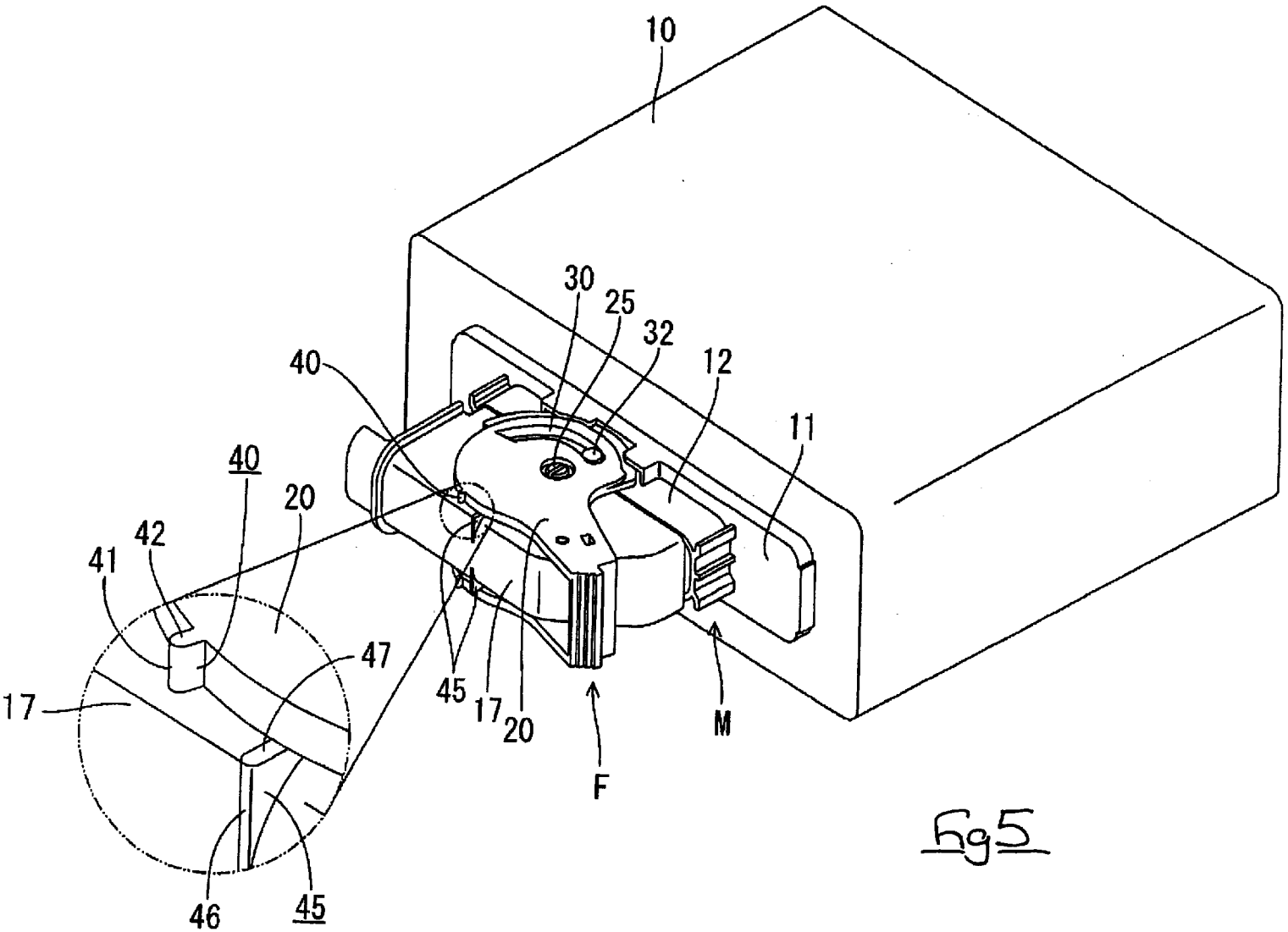
FIG. 5 is a diagonal view showing a lever which has been pivoted to the vicinity of an ending position.

The lever 20 is attached to the female connector F. This lever 20 has a bifurcated shape whereby tips of a pair of arms 21 thereof, these arms 21 having disk-shaped base ends 22, are joined by an operating member 23. The lever 20 is attached so as to straddle the cover 17 from the exterior. The base ends 22 of the arms 21 are supported by axles 25 formed in both side faces of the cover 17. The lever 20 can be pivoted between a starting position (shown in FIG. 1) and an ending position (shown in FIG. 6). As shown in FIG. 2, the lever 20 is maintained in the starting position by means of semi-retaining protrusions 27, which protrude from the cover 17 and fit into circular semi-retaining holes 26 which open into the lever 20. The lever 20 is maintained in the ending position by means of square main retaining protrusions 28 fitting into main retaining holes 29 of the cover 17.

Cam grooves 30, which have a specified curved shape, are formed in the base ends 22 of the arms 21 of the lever 20, and follower pins 32 protrude from upper and lower faces of the hood 12 of the male housing 11. These follower pins 32 fit into the cam grooves 30. When the lever 20 is in the starting position, openings 31 of the cam grooves 30 (these openings 31 being provided at starting position sides 30A thereof) are open towards the anterior side.

Consequently, when the female housing 16 is fitted into the hood 12 of the male housing 11 while the lever 20 is being maintained in the starting position, the follower pins 32 are moved from the openings 31 to the starting position sides 30A of the cam grooves 30. Then, as the lever 20 is pivoted, the follower pins 32 are moved within the cam grooves 30 while the cam operation thereof gradually draws the female housing 16 into the hood 12. When the lever 20 is pivoted to the ending position, the female housing 16 is correctly fitted within the hood 12, and corresponding male and female terminal fittings make contact correctly.

Markers are provided between the lever 20 and the cover 17, these being used to visually ascertain whether the lever 20 has been pivoted to the ending position. Firstly, first ribs 40 protrude from outer circumference edges of the base ends 22 of the arms 21 of the lever 20, at locations opposite the portions of the lever 20 which are between ending position sides 30B of the cam grooves 30 and the axes 25. When the lever 20 has reached the ending position, these first ribs 40 face the posterior relative to the direction of insertion of the female housing 16, and protruding edges 41 of the first ribs 40 form a unified face with a ceiling face 17A of the cover 17.

Second ribs 45 are formed on portions of left and right side edges of the ceiling face 17A of the cover 17, at locations corresponding to the position in which the first ribs 40 are located when the lever 20 has been rotated to the ending position. The left and right side edges of the ceiling face 17A of the cover 17 have rounded-off comers. However, the second ribs 45, which are formed at a right angle to the left and right side edges, have angled comers extending to the location where the corners of the side edges would be if they were not rounded off. As a result of this rounding-off shape, ceiling-face ends (i.e., the opposite ends to the angled comers) of protruding edges 46 of the second ribs 45 form a unified face with the ceiling faces 17A of the cover 17. Similarly, side-face ends (i.e. the opposite ends to the angled corners) of protruding edges 47 of the second ribs 45 form a unified face with side faces 17B of the cover 17.

Next, the operation of the present embodiment will be described. As shown in FIG. 1, when the two housings 11 and 16 are to be fitted together, the lever 20, which is attached to the female housing 16, is maintained in the starting position. Then the female housing 16 is fitted into the hood 12 of the male housing 11, whereupon the follower pins 32 of the male housing 11 move from the openings 31 to the starting position sides 30A of the cam grooves 30. Then, while the operating member 23 is being pressed by a finger, the lever 20 is pivoted towards the end position, the cam operation between the follower pins 32 and the cam grooves 30 gradually drawing the female housing 16 into the hood 12 (see FIG. 5). The follower pins 32 are moved towards the ending position sides 30B of the cam grooves 30 while the lever 20 is being pivoted towards the end position. When the female housing 16 has been correctly fitted within the hood 12, the main retaining protrusions 28 fit into the main retaining holes 29, thereby locking the two housings. Simultaneously, the corresponding male and female terminal fittings are maintained in a state whereby they make contact correctly.

Figure 6:
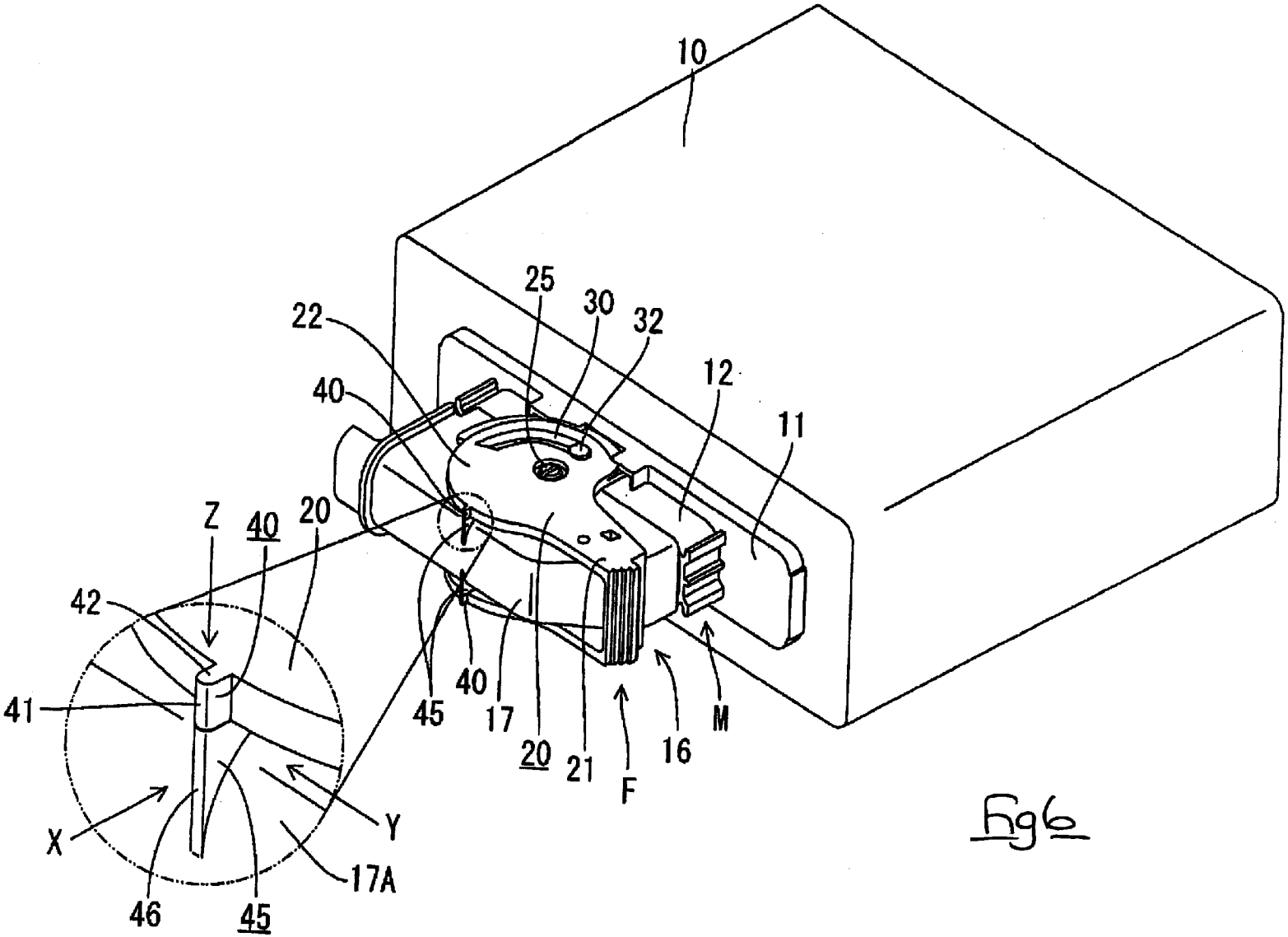
FIG. 6 is a diagonal view showing the lever which has been pivoted to the ending position.

As shown in FIG. 6, if one observes the left and right angled comer portions of the ceiling face 17A of the cover 17 when the lever 20 has been pivoted to the end position, the first ribs 40 of the lever 20 and the second ribs 45 of the cover 17 are aligned above and below in a straight line. This allows one to verify that the lever 20 has been correctly rotated to the ending position. If the markers are viewed from the front (from the direction shown by the arrow X in FIG. 6), the protruding edges 41 of the first ribs 40 are aligned vertically with the protruding edges 46 (the ceiling face ends) of the second ribs 45. If the markers are viewed from the side (from the direction shown by the arrow Y in FIG. 6), the left sides of the protruding edges 41 of the first ribs 40 are aligned vertically with the protruding edges 46 (the ceiling face ends) of the second ribs 45. If the markers are viewed from above (from the direction shown by the arrow Z in FIG. 6), only a side edge 42 of one of the first ribs 40 is visible. In this manner, one can verify that the ribs 40 and the 45 are aligned.

It is possible that, when the lever 20 has been pivoted to the vicinity of the ending position, resistance such as joining resistance between the terminal fittings may halt the movement of the lever 20 even though the lever operation means that less fitting force is required. In such a case, the lever 20 is halted before it has reached the correct end position, and the two housings 11 and 16 remain in a half-fitted state. In that case, observation of the markers will show a gap between the first ribs 40 of the lever 20 and the second ribs 45 of the cover 17 (see FIG. 5). In this manner, one can verify that the lever 20 has not been moved to the correct end position. Then one can resume movement of the lever 20, and verify that the two ribs 40 and 45 have been aligned.

In the present embodiment, after the lever 20 has been pivoted, one can observe whether the first ribs 40 of the lever 20 are aligned with the second ribs 45 of the cover 17. Consequently, one can ascertain whether the lever 20 has been correctly pivoted to the end position. That is, one can simply and reliably ascertain whether the two housings 1I and 16 have been correctly fitted together.

The shape of the two ribs 40 and 45 allows one to view the markers from three directions, (from the front, the side, and above), so as to verify whether the markers have been aligned.

The two ribs 40 and 45 are formed so as to be housed within the outer form of the cover 17. Consequently, foreign objects do not strike against them, and damage thereto is prevented.

Figure 7:
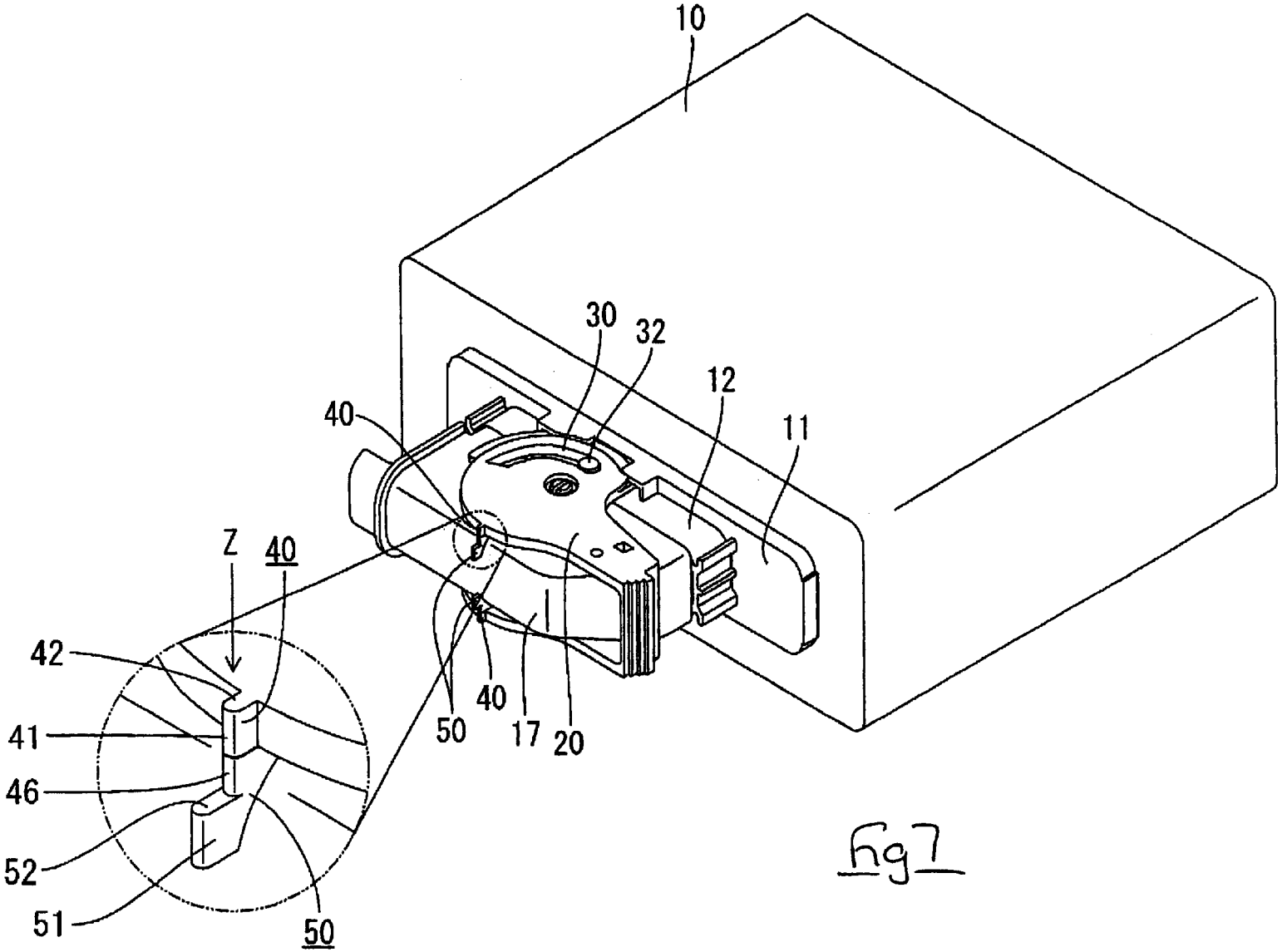
FIG. 7 is a diagonal view showing a second embodiment of the present invention wherein the lever has been pivoted to the ending position.

A second embodiment of the present invention is described below with the aid of FIG. 7. This second embodiment differs from the first in that second ribs 50 located on the cover 17 have a differing shape. That is, protruding portions 51 (the ends of the second ribs 50 opposite the angled ends thereof) located on the ceiling face 17A of the cover 17 protrude outwards for a specified distance relative to the first ribs 40 of the lever 20.

The remaining configuration is the same as the first embodiment and accordingly the same symbols are used and an explanation of the function thereof is omitted.

In the second embodiment, if the markers are viewed from above (from the direction shown by the arrow Z in FIG. 7), the side edges 42 of the first ribs 40 are aligned horizontally with side edges 52 of the protruding portions 51 of the second ribs 50. Consequently, one can verify that the ribs 40 and the 50 are aligned. That is, the ribs 50 are not hidden. Instead, both the ribs 40 and 50 can be seen while their alignment is being verified. Consequently, a more reliable judgement can be made.

The present invention is not limited to the embodiments described above with the aid of figures. For example, the possibilities described below also lie within the technical range of the present invention. In addition, the present invention may be embodied in various other ways without deviating from the scope thereof.

(1) The markers may equally well be formed in a shape opposite to that of the embodiments described above. That is, they may be formed in a concave shape. Alternatively, the markers may consist of painted-on lines which have differing colours.

(2) The present invention is equally suited to a lever-type connector using conventional wire to wire attachment.

Furthermore, it is equally suited to a case wherein the lever is provided on the male housing.

What is claimed is:

1. A lever-type connector assembly comprising a pair of mutually engageable connectors, a lever pivotably supported on a first one of the connectors and defining a cam, and a follower disposed on the other connector and engageable with said cam such that pivoting of said lever to an end position draws said connectors fully together, wherein:

said lever comprises a first rib that extends outward from a surface of the lever, and that has a long axis and a short axis, said first connector comprises a second rib that extends outward from a surface of the first connector and that has a long axis and a short axis, the first and second ribs are aligned when the lever is in the end position, and said alignment is exposed and observable from the front of the first connector, from a side of the first connector, and from at least one of the top and bottom of the first connector.

2. A connector assembly according to claim 1 wherein the long axis of said ribs is parallel to the pivot axis of said lever.

3. A connector assembly according to claim 1 wherein one of said ribs, the pivot axis of said lever and said follower are aligned when the lever is in said end position.

4. A connector assembly according to claim 1 wherein the long axes of the first and second ribs are aligned when the lever is in said end position.

5. A connector assembly according to claim 4 wherein the first connector comprises a housing and a cover therefor, and wherein the second rib extends outward from a surface of the cover.

6. A connector assembly according to claim 4 wherein said ribs are immediately adjacent when the lever is in said end position.

7. A connector assembly according to claim 4 wherein said ribs have the same thickness.

8. A connector assembly according to claim 4 wherein said ribs have different heights so as to be both visible when viewed on end.

9. A connector assembly according to claim 1 wherein said ribs are immediately adjacent when the lever is in said end position.

10. A connector assembly according to claim 9 wherein said ribs have the same thickness.

11. A connector assembly according to claim 9 wherein said ribs have different heights so as to be both visible when viewed on end.

12. A connector assembly according to claim 1 wherein said ribs have the same thickness.

13. A connector assembly according to claim 12 wherein said ribs have different heights so as to be both visible when viewed on end.

14. A connector assembly according to claim 1 wherein said ribs have different heights so as to be both visible when viewed on end.

15. A connector assembly according to claim 14 wherein the long axis of said ribs is parallel to the pivot axis of said lever.

16. A connector assembly according to claim 1 wherein said lever has arms extending on the top and bottom of the first connector, the arms being pivotably attached to said first connector on a common pivot axis, wherein the first rib extends from one of said arms and a third rib extends from the other arm.

17. A connector assembly according to claim 16 wherein said connectors have a fitting axis, and in the end position said ribs are aligned and perpendicular to said fitting axis.

* * * * *